US005673602A

United States Patent [19]

Seikai et al.

[11] Patent Number: 5,673,602

[45] Date of Patent: Oct. 7, 1997

[54] METHOD AND APPARATUS FOR MAKING PERFORATIONS CONTINUOUSLY

[75] Inventors: Hiroshi Seikai; Koichi Takahashi; Mituru Suzuki; Hiroshi Tsuzaki, all of Kanagawa, Japan

[73] Assignee: Fuji Photo Film Co., Ltd., Kanagawa, Japan

[21] Appl. No.: 546,270

[22] Filed: Oct. 20, 1995

Related U.S. Application Data

[63] Continuation of Ser. No. 132,978, Oct. 7, 1993, abandoned.

[30] Foreign Application Priority Data

Oct. 7, 1992 [JP] Japan ..... 4-268785

[51] Int. Cl.[6] ..... B26F 1/08

[52] U.S. Cl. ..... 83/37; 83/100; 83/338; 83/352; 83/356.2

[58] Field of Search ..... 83/37, 337, 338, 83/345, 352, 356.2, 356.3, 100

[56] References Cited

U.S. PATENT DOCUMENTS

| | | | |
|---|---|---|---|
| 1,559,987 | 11/1925 | Reinhardt | 83/337 |
| 2,619,177 | 11/1952 | Praturlon | 83/338 |
| 3,126,779 | 3/1964 | Welch et al. | 83/338 |
| 3,661,044 | 5/1972 | Duden et al. | 83/345 X |
| 3,894,458 | 7/1975 | Borello | 83/337 X |
| 3,943,810 | 3/1976 | Muylle | 83/337 |
| 4,134,319 | 1/1979 | Clark | 83/337 X |
| 4,747,895 | 5/1988 | Wallerstein et al. | 156/73.3 |
| 5,317,942 | 6/1994 | Nakajima | 83/337 X |

FOREIGN PATENT DOCUMENTS

| | | | |
|---|---|---|---|
| 2473939 | 1/1980 | France . | |
| 1007169 | 4/1957 | Germany | 83/337 |
| 2039801 | 2/1972 | Germany | 83/337 |
| 471477 | 5/1952 | Italy | 83/337 |
| 56-98597 | 8/1981 | Japan . | |
| 63-191598 | 8/1988 | Japan . | |
| 0454611 | 6/1968 | Switzerland . | |

*Primary Examiner*—Rinaldi I. Rada
*Assistant Examiner*—Clark F. Dexter
*Attorney, Agent, or Firm*—Sughrue, Mion, Zinn, Macpeak, and Seas

[57] ABSTRACT

A perforator has a rotary drum. A plurality of die sets are arranged at regular intervals around a peripheral surface of the drum and circulates along with the peripheral surface. Each of the die sets has a pair of die and punch. The die is secured to a die holder which is mounted to the peripheral surface, and the punch is secured to a punch holder which is linearly movable in a direction perpendicular to the peripheral surface between a punch position where the punch is fitted in the die and a retracted position where the punch is retracted away from the die. The sheet material is brought into contact with the peripheral surface within a predetermined range, and conveyed on the peripheral surface in the same direction at the same speed as the die sets. An annular punch drive cam disposed surrounding the peripheral surface drives the punch holder to move between the punch position and the retracted position. The punch or the sheet material is shifted into a relief position where the punch cannot interfere with the sheet material beyond the predetermined contact range of the sheet material with the peripheral surface.

10 Claims, 14 Drawing Sheets

METHOD AND APPARATUS FOR MAKING PERFORATIONS CONTINUOUSLY

This is a continuation of application Ser. No. 08/132,978 filed Oct. 7, 1993, now abandoned.

BACKGROUND OF THE INVENTION

1. Field of the Invention

The present invention relates to a method and apparatus for making perforations continuously along a long strip of sheet material while conveying the long strip at a high speed in a longitudinal direction.

2. Description of the Related Art

Successive perforating apparatus are well known. JPA 2-109700, JPA 63-222787, JPA 63-191598, JPA 63-52998 (which corresponds to U.S. Pat. No. 4,747,895) and JPU 56-98597 for example, disclose such devices. JPU 56-98597 discloses an apparatus wherein a plurality of die sets, each having a punch and die pair incorporated therein, are disposed on the outer periphery of a rotary wheel to endlessly circulate or rotate the die sets around a rotary axis of the wheel. A strip of photographic film is wound on the outer periphery of the rotary wheel to be successively perforated by the die sets.

Each die set is comprised of a die holder having the die and a punch carrier arm having the punch. The die holder has a shaft formed integrally therewith and extending in a direction orthogonal to the rotational axis of the wheel. The punch carrier arm pivots about the shaft coupled thereto at the middle portion thereof. The punch is integrally formed on one end of the punch carrier arm. The opposite end of the punch carrier arm is engaged in an annular stationary cam groove formed surrounding the wheel. The cam groove has a curve which causes the punch carrier arm to pivot between a punch position, where the punch is removed from the die. In this way, perforations are successively formed in the photographic film while the photographic film is conveyed by the wheel at the rotating speed of the wheel by virtue of the engagement between the perforations and the punches.

When perforating, it is desirable to avoid cracks or burrs in the cutting surfaces. A proper or optimum clearance is essential for this requirement. However, in order to maintain the optimum clearance constant in the entire stroke of the punch, it is necessary to arch the shape of the punch and the cavity of the die because of the pivotal punching motion of the punch carrier arm. Such an arched punch and die cavity are difficult to manufacture, so that the manufacturing cost thereof is increased.

SUMMARY OF THE INVENTION

An object of the present invention is to provide a method of making successive perforations along a long strip of sheet material wherein the optimum clearance between a pair of punch and die can always be maintained constant without the need for expensive construction.

Another object of the present invention is to provide a perforator for executing the method.

According to the method of the present invention, the punch is moved linearly toward the die in a direction perpendicular to the sheet material conveyed on a rotating surface along with the die sets, when perforating the sheet material. Thus, the optimum clearance is maintained constant in the entire stroke of the punch, and it is unnecessary to arch the punch and the die cavity.

A perforator of the present invention provides a circulating device, such as a drum, having a peripheral surface rotating in a first direction, a plurality of die sets arranged at regular intervals around the peripheral surface of the circulating device and circulating along with the peripheral surface in the first direction. Each of the die sets having a die and punch pair. The die is secured to a die holder which is mounted to the peripheral surface, and the punch is secured to a punch holder which is linearly movable in a second direction perpendicular to the peripheral surface between a punch position, where the punch is fitted in the die, and a retracted position, where the punch is retracted away from the die.

At least a pair of rollers are disposed outside the circulating device to bring the sheet material into contact with the peripheral surface, and convey the sheet material on the peripheral surface in the first direction at the same speed as the die sets. A punch drive device is coupled to the punch holder to drive the punch holder to move in the second direction. The punch is kept in the punch position for a predetermined circulating period of the die sets to nip the sheet material between the dies and the punches through the perforations.

According to a preferred embodiment of the invention, the punch drive device includes a cam and a sliding member coupled to the cam and disposed in each die set. The sliding member is slidable in the direction perpendicular to the peripheral surface, to transmit only perpendicular motions from the cam to the punch holder with respect to the peripheral surface.

According to another preferred embodiment, the perforator further comprises a shift device for shifting the punch or the sheet material relative to each other in a direction traversing the peripheral surface into a relief position where the punch cannot interfere with the sheet material when the sheet material is approaching or leaving the peripheral surface.

BRIEF DESCRIPTION OF THE DRAWINGS

Other objects and advantages of the present invention will become apparent through the following detailed description of the preferred embodiments when read in connection with the accompanying drawings, wherein like reference numerals designate like or corresponding parts throughout the several views, and wherein.

DETAILED DESCRIPTION OF THE PREFERRED EMBODIMENTS

Figure 1:
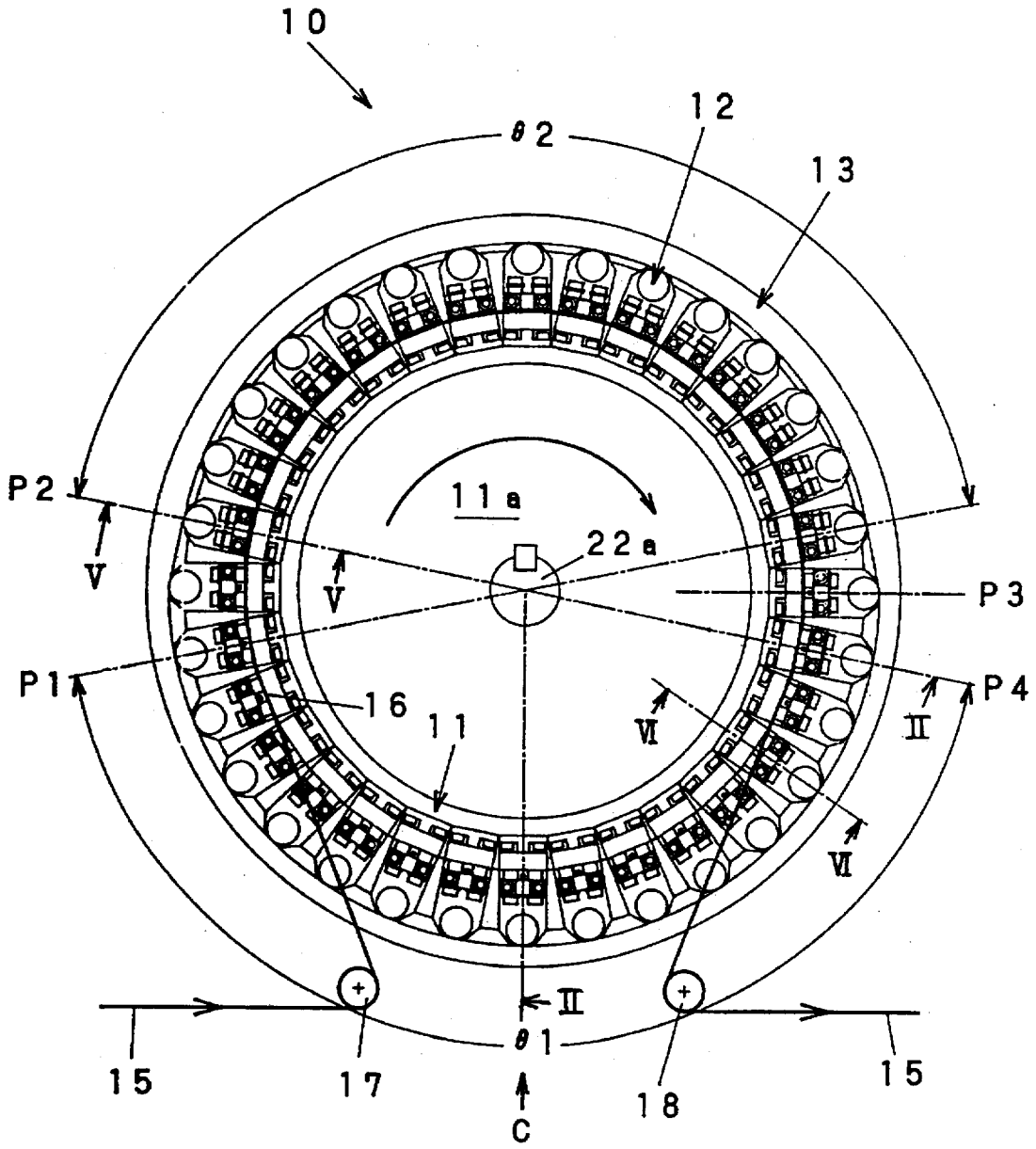
FIG. 1 is a front view of a perforator according to a first embodiment of the invention, with parts broken away for clarity.
Figure 2:
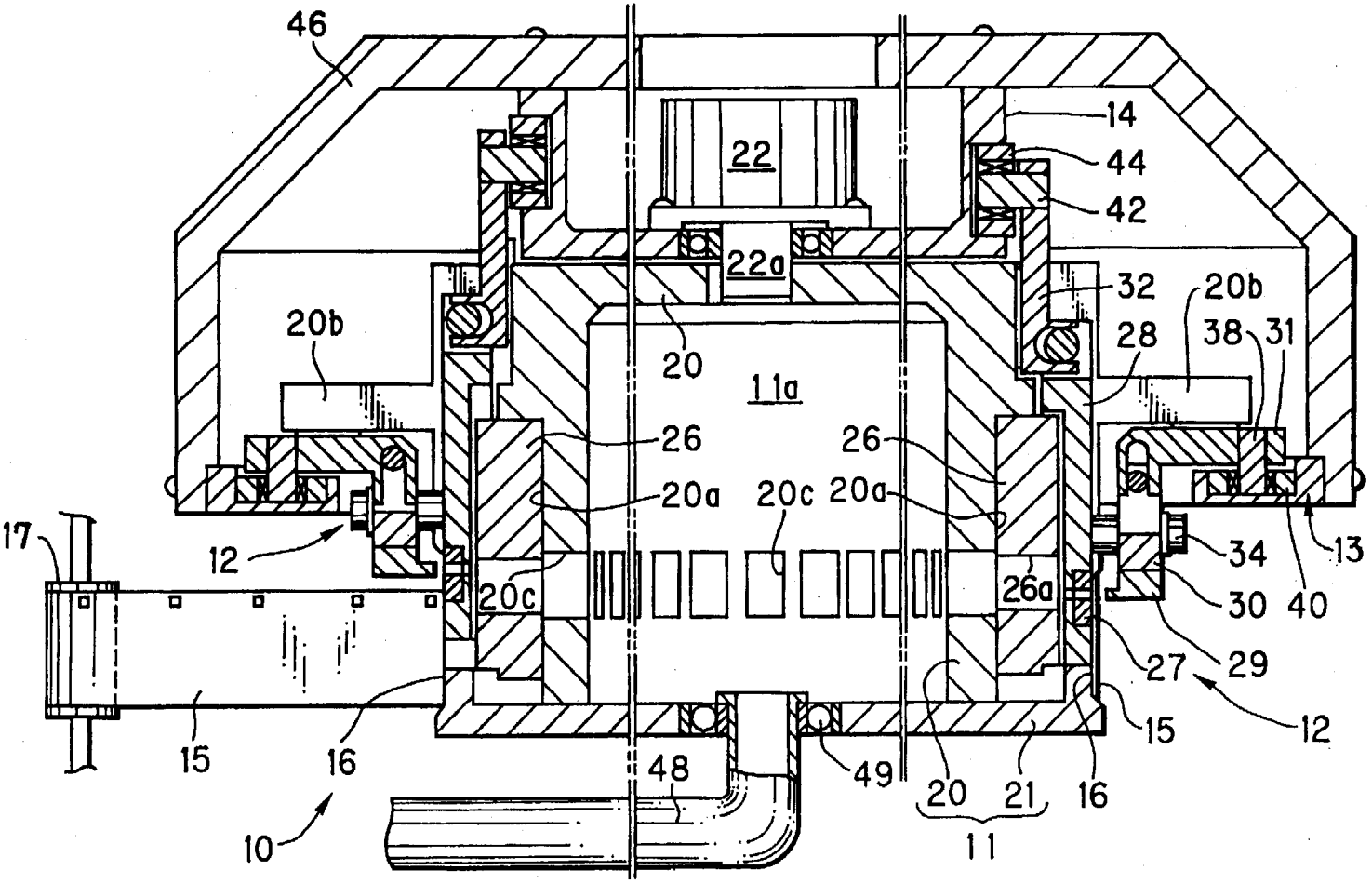
FIG. 2 is a vertical sectional view of the perforator taken along line II—II in FIG. 1, with parts broken away for clarity.

Referring to FIGS. 1 and 2, a successive perforator 10 has a rotary drum 11, a plurality of die sets 12 each having a punch and die pair incorporated therein, an annular punch drive cam 13 and a die drive cam 14. The rotary drum 11 has a film conveying surface 16 formed around the outer periphery thereof. A pair of path rollers 17 and 18 whose spindles extend parallel to the rotary axis of the drum 11 are disposed in the vicinity of the drum 11. Through these path rollers 17 and 18, a loop of a long strip of sheet material, for instance, a photographic filmstrip 15 is tightly wound around the film conveying surface 16 of the drum 11 by a predetermined contact angle, so that the photographic filmstrip 15 is not deflected transversely from the film conveying surface 16.

An initial contact position where the filmstrip 15 comes into contact with the film conveying surface 16, and a final contact position where the filmstrip 15 leaves the film conveying surface 16 are disposed within an annular range shown by θ1 in FIG. 1. By virtue of the punch drive cam 13 and the die drive cam 14, the die sets 12 are set in their relief positions, in this angular range θ1, wherein the punch and die pairs do not interfere with the filmstrip 15, as will be described in detail below.

The rotary drum 11 is constituted of a substantially cylindrical frame 20 and a bottom cover 21. A rotary shaft 22*a* of a drive motor 22 is coupled to the rotational center of the frame 20. The frame 20 has a plurality of stepped recess portions 20*a* disposed at regular intervals around the periphery of the inner frame 20, each for receiving one of the die sets. In FIG. 1, the bottom cover 21 and a part of the punch drive cam 13 are omitted or broken away for clarity.

As shown in detail in FIGS. 3 to 6, the die set 12 is constituted of a base 26 secured to the stepped recess portion 20*a*, a die 27, a die holder 28 having the die 27 secured thereto, a punch 29, a punch holder 30 having the punch 29 secured thereto, a punch drive member 31 and a die drive member 32. The die holder 28 is coupled to the base 26 through a slide guide 28*b* (see FIG. 6) which permits the die holder 28 to move relative to the base 26 in a direction parallel to the rotary axis of the drum 11. A pair of guide rods 34 extending in a direction perpendicular to the film convey surface 16 of the drum 11 and in parallel to each other, are secured at one end thereof, to the die holder 28. The other ends of the guide rods 34 are fitted into bearings 36 which are securely mounted in the punch holder 30 so as to permit the punch holder 30 to move along the guide rods 34, that is, in the radial direction of the drum 11 relative to the die holder 28 (see FIG. 3). The punch holder 30 also moves in the axial direction of the drum 11 in cooperation with the die holder 28.

It is to be noted that the direction perpendicular to the film convey surface 16 is equivalent to the radial direction of the drum 11 under the conditions that the drum 11 is cylindrical. Therefore, a direction perpendicular to the film conveying surface 16 will be hereinafter referred to as a radial direction of the drum 11 throughout the description of the preferred embodiments shown in the drawings. However, the direction perpendicular to a film conveying surface is not always a radial direction. The bearing 36, for allowing rectilinear motion of the punch holder 30, may be a ball-and-roller bearing or a plain bearing. It is possible to use a single guide rod if the guide rod has such a construction that prevents rotation of the punch holder 30 about the axis of the guide rod, for example, a key groove or if the guide rod is of a rectangular shape.

Figure 3:
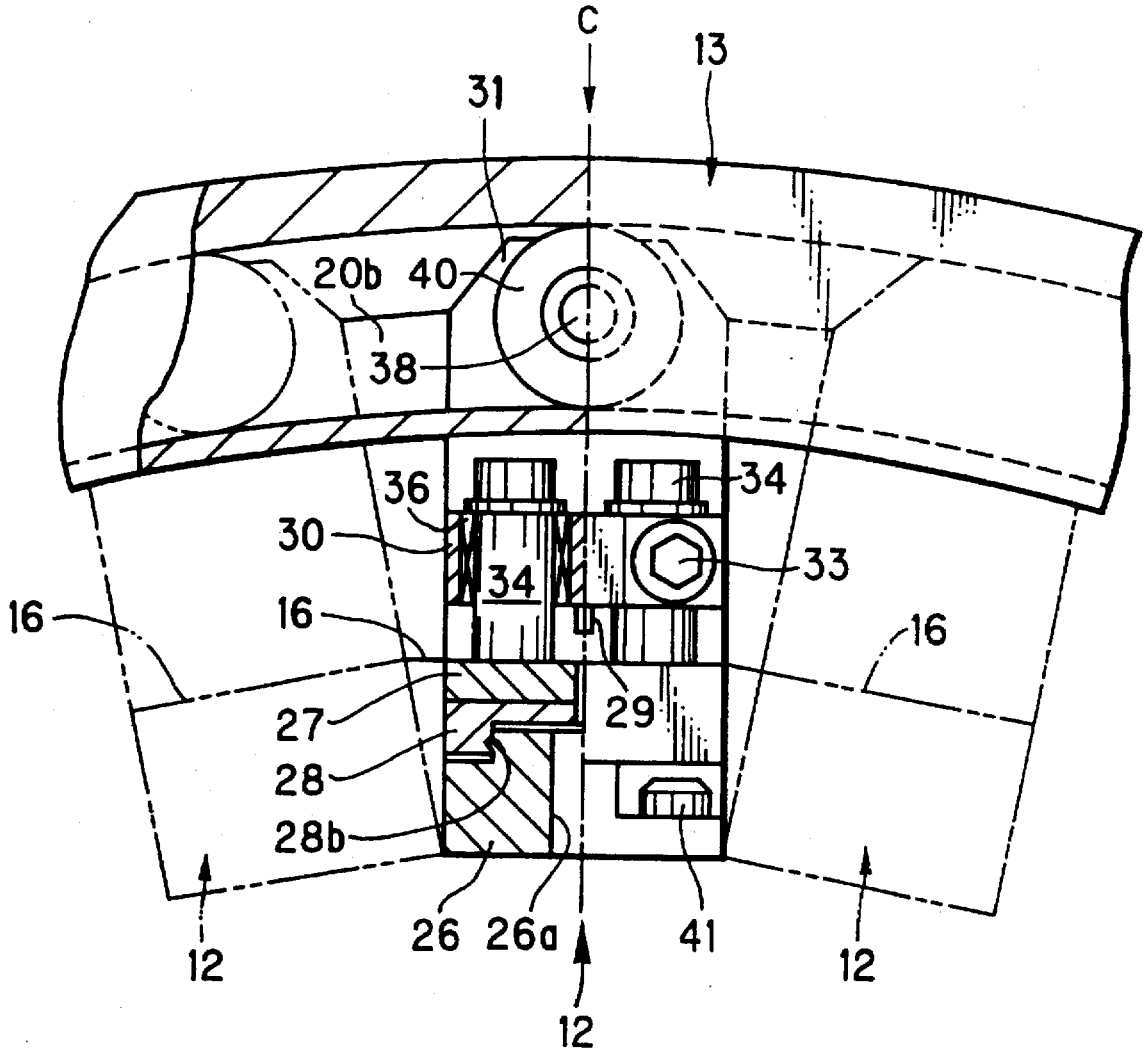
FIG. 3 is a front view of a die set of the perforator shown in FIG. 1, partly in cross section.
Figure 4:
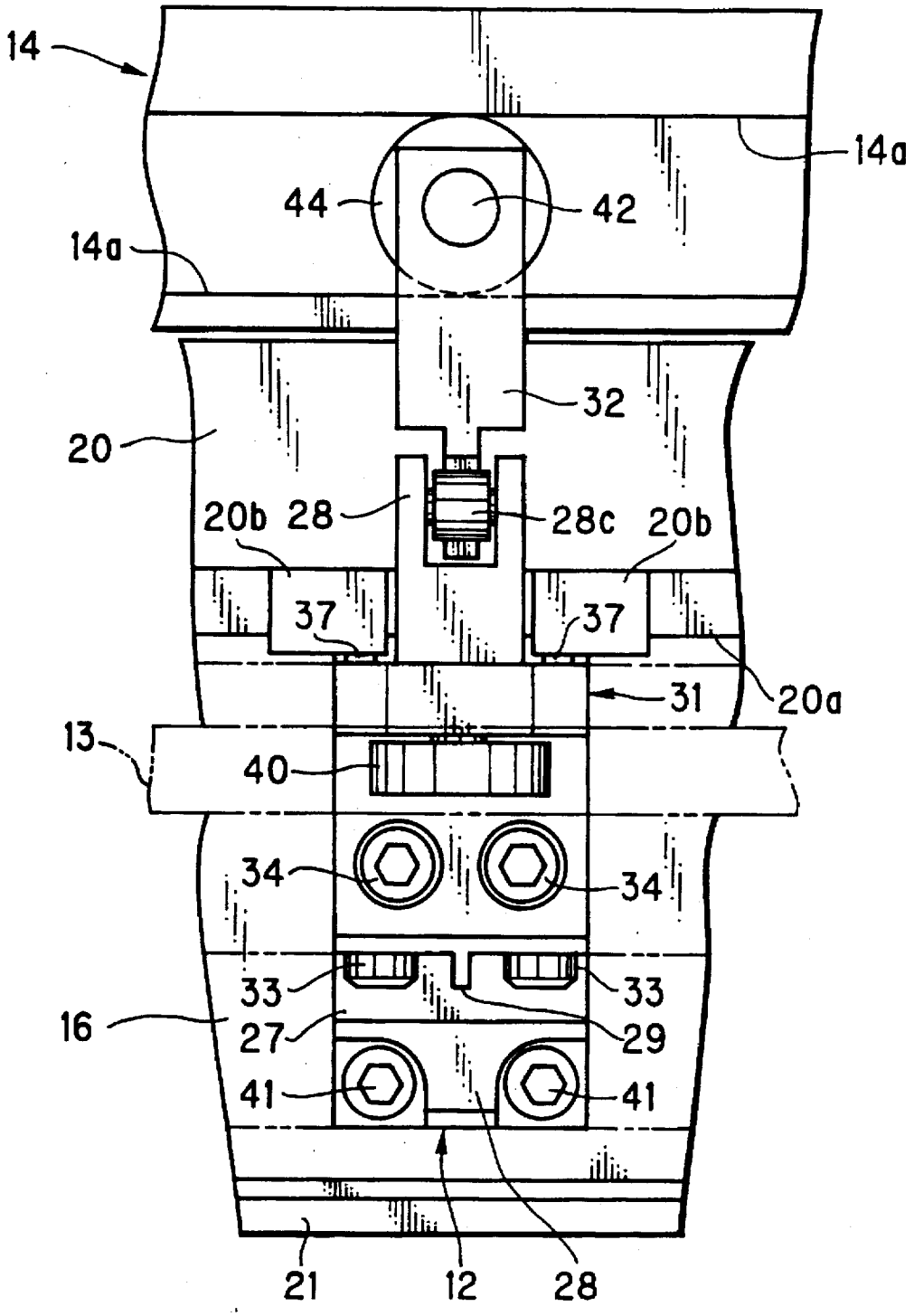
FIG. 4 is a view of the die set in the direction of the arrow C in FIGS. 1 or 3.
Figure 5:
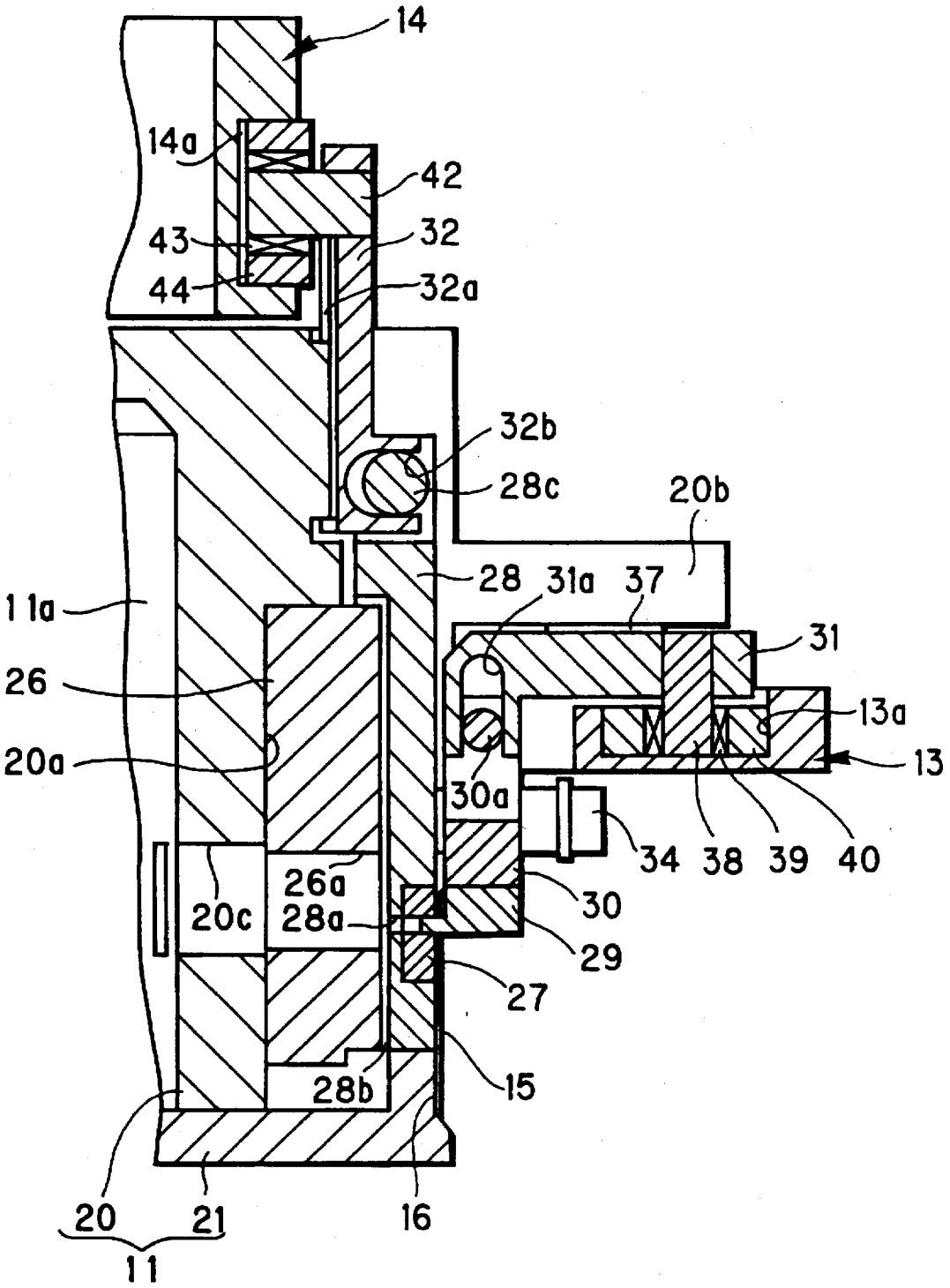
FIG. 5 is a sectional detail view taken along line V—V of FIG. 1, illustrating the die set in its punch position.

The end of the punch holder 30 that is opposite to the punch 29 is linked to the punch drive member 31 through an engagement between a slider 30*a* of the punch holder 30 and a slit 31*a* of the punch drive member 31 (see FIG. 5). The slit 31*a* extends in the axial direction of the drum 11, the punch holder 30 can move in the axial direction relative to the punch drive member 31. The punch drive member 31 is slidable through a slide guide 37 along a pair of radial projections 20*b* formed on the periphery of the frame 20 in association with each stepped recess portion 20*a*. A shaft 38 extending in the axial direction of the drum 11 is secured to the punch drive member 31 at the opposite end from the slit 31*a*, and a roller 40 is rotatably mounted on the shaft 38 through a bearing 39. Elements 33 and 41 in FIGS. 3 and 4 are set screws.

Figure 6:
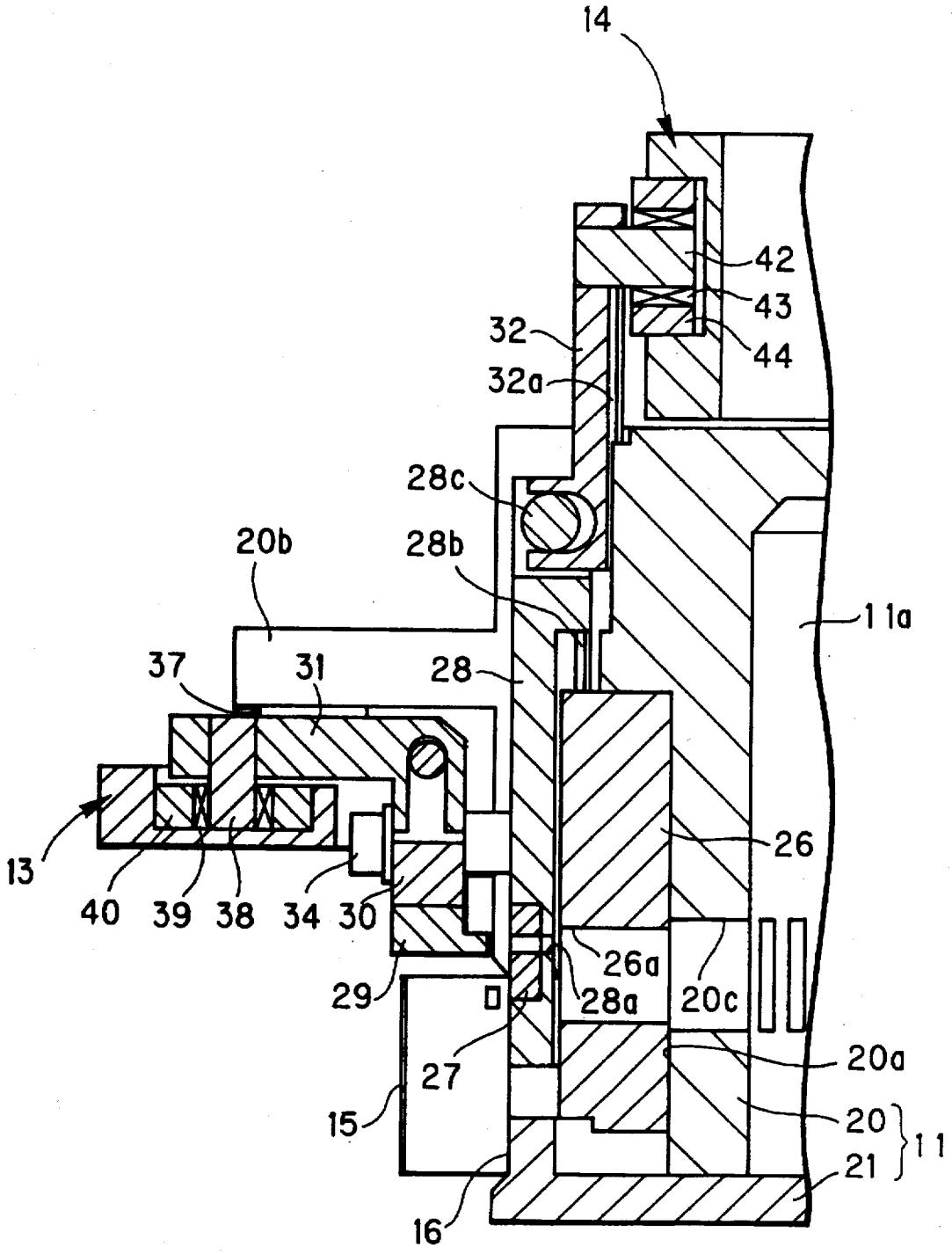
FIG. 6 is a sectional detail view taken along line VI—VI of FIG. 1, illustrating the die set in its relief position.

The roller 40 is engaged in an annular cam groove 13*a* formed in the punch drive cam 13 which is disposed around the drum 11 in a stationary manner. When the drum 11 is rotated, the roller 40 slides along the cam groove 13*a*. Because the cam groove 13*a* has a small radius of curvature in an angular range shown by θ2 in FIG. 1 than in the angular range θ1, the roller 40 is caused to move radially inwardly in the range θ2 relative to the range θ1. The punch drive member 31 transmits the radial motion of the roller 40 to the punch holder 30, thereby to move the punch holder 30 rectilinearly along the guide rods 34. As a result, the punch holder 30 is brought into a punch position in the range θ2 where the punch 29 is fitted in the cavity of the die 27, as is shown in FIG. 5. While in the range θ1, the punch holder 30 is in a retracted position where the punch 29 is removed off the die 27, as is shown in FIGS. 2 and 6.

The die drive member 32 is mounted on the frame 20 of the drum 11 through a slide guide 32*a* so as to be slidable on the periphery of frame 20 in the axial direction of the drum 11. A shaft 42 extending in a radial direction of the drum 11 is secured to one end of the die drive member 32, and a roller 44 is rotatably mounted on the shaft 42 through a bearing 43. The opposite end of the die drive member 32 is linked to the die holder 28 through a linkage between a radial slit 32*b* of the die drive member 32 and a roller 28*c* of the die holder 28. Thereby, the die holder 28 can move in the axial direction in cooperation with the die drive member 32.

The roller 44 is engaged in a circular cam groove 14*a* formed in the die drive cam 14 coaxial with the drum, so as to slide along the cam groove 14*a* with the rotation of the drum 11. The die drive cam is secured to a stationary outer frame 46 of the perforator 10. The course of the cam groove 14*a* curves in the axial direction so that the roller 44 changes its axial location while sliding along the cam groove 14*a*. The die drive member 32 transmits the axial motion of the roller 44 to the die holder 28. Thereby, the die holder 28 and thus the punch holder 30 are axially displaced between the relief position shown in left hand side of FIG. 2 or in FIG. 6 and a standby position shown in right hand side in FIG. 2.

In the standby position, the punch 29 and the die 27 are disposed on the opposite surfaces of the photographic filmstrip 15 which is in contact with the film conveying surface 16. From this standby position, the punch holder 30 is moved radially inwardly into the punch position as shown in FIG. 5, and maintained in the punch position in the range θ2, by virtue of the punch drive cam 13.

In order to eject chips subsequent to the die-punching of the photographic filmstrip 15, holes 28*a*, 26*a* and 20*c* are formed through the die holder 28, the base and the stepped recess portion 20*a* of the frame 20, respectively, in alignment with one another. Through these holes, the chips are gathered in an interior 11*a* of the drum 11, and ejected therefrom to the outside of the perforator 10 through a suction hose 48 which is connected to the rotation center of the bottom cover 21 through a bearing 49.

The operation of the above-described embodiment is as follows:

First, the photographic filmstrip 15 is wound around the drum 11 along the film conveying surface 16 by way of the path rollers 17 and 18. When the motor 22 is driven under this condition, the drum 11 is rotated in a direction shown by an arrow in FIG. 1. At a position indicated by P1 in FIG. 1, that is, a position immediately after the initial contact position in the rotating direction of the drum 11, the die drive cam 14 causes the die drive member 32 to move in the axial direction of the drum 11 so as to move the die holder 28 and thus the punch holder 30 in the axial direction from the relief position into the standby position to prepare for a die-punching operation.

At a position indicated by P2 in FIG. 1, the punch drive cam 13 causes the punch drive member 31 to move radially toward the rotational center of the drum. Thereby, the punch holder 30 moves along the guide rods 34 into the punch position where the punch 29 is fitted in the die 27. In this way, the photographic filmstrip 15 is successively perforated at the position P2 while being conveyed by the drum 11.

Because each pair of the die holder 28 and the punch holder 30 is incorporated into the die set 12, the relative position of the pair is maintained unchanged in the rotating direction of the drum 11. By virtue of the punch drive member 31, the motion of the roller 40 in the rotating direction of the drum 11 is prevented from being transmitted to the punch holder 30, and the punch 29 is moved radially rectilinearly into the die 27. Therefore, it is easy to maintain the optimum clearance constant throughout the entire stroke of the punch 29. Because it is unnecessary to arch the punch 29 or the cavity of the die 27, the manufacturing cost can be low.

Because the punch holders 30 are kept in the punch position throughout the angular range θ2, the photographic filmstrip 15 is nipped between the punches 29 and dies 27 in this range θ2. Thereby, the photographic filmstrip 15 is exactly conveyed at the same speed as the rotational speed of the drum 11. Accordingly, the position of the photographic filmstrip 15 relative to the film conveying surface 16 remains unchanged in the contact range from the initial contact position to the final contact position, so that the pitch or interval of the perforations is maintained precisely constant.

At a position indicated by P3 in FIG. 1, that is, a position immediately after the angular range θ2 in the rotating direction of the drum 11, the punch drive cam 13 causes the punch drive member 31 to move the punch holder 30 radially outwardly from the drum 11 along the guide rods 34. Thereby, the punch 29 is removed from the die 27.

At a position indicated by P4 in FIG. 1, that is, a position immediately before the final contact position in the rotating direction of the drum 11, the die drive cam 14 causes the die drive member 32 to move the die holder 28 and thus the punch holder 30 in the axial direction of the drum 11 into the relief position. Thereafter, the photographic filmstrip 15 is removed from the film conveying surface 16, as is shown in FIG. 1. Thus, the relative position of each pair of the punch holder 30 and the die holder 28 is also maintained unchanged in the axial direction, so that the optimum clearance is maintained constant also in the axial direction.

Figure 7:
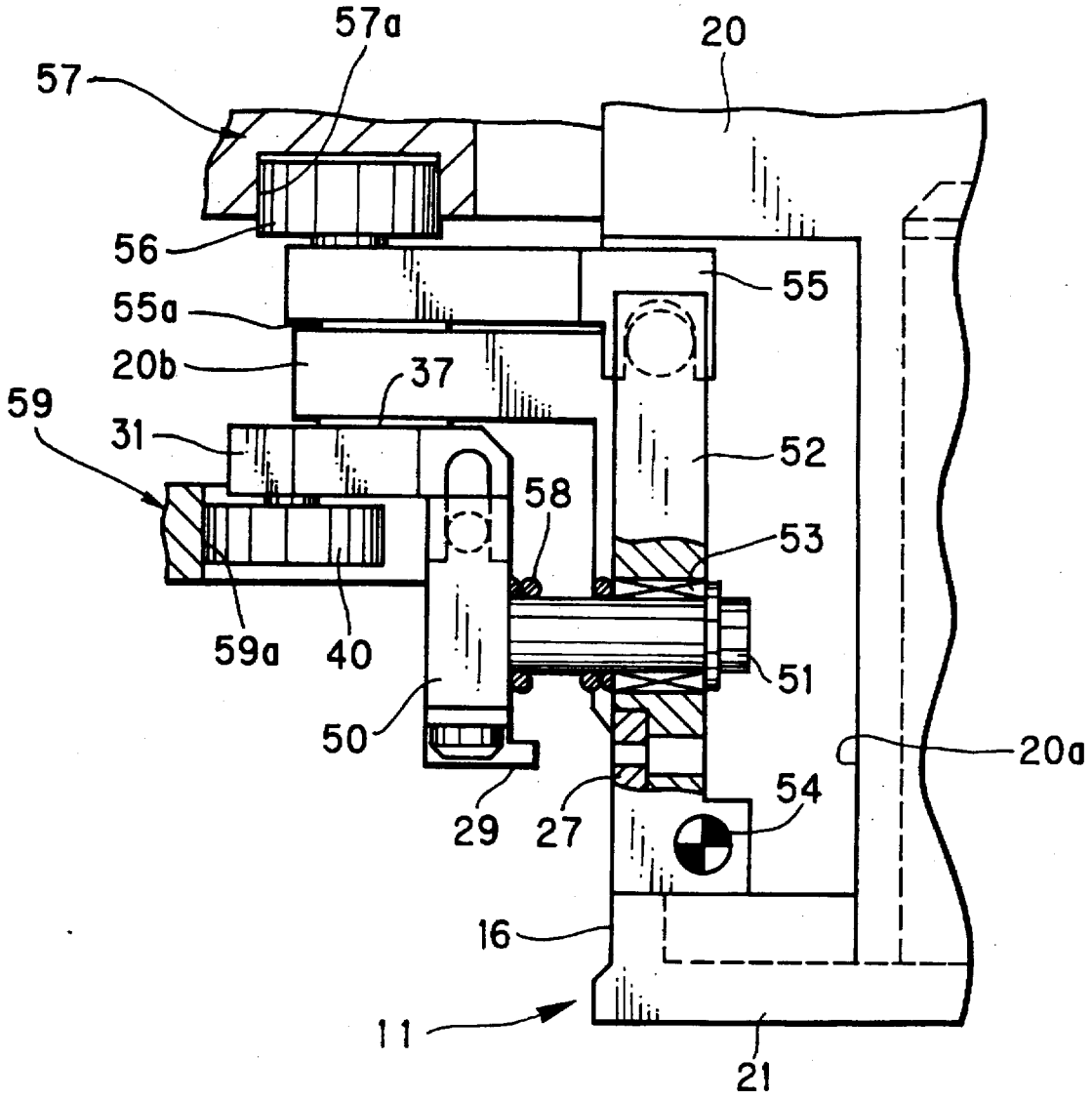
FIG. 7 is a side view, partly in cross section, of a die set according to a second embodiment of the invention, illustrating a standby position thereof.
Figure 8:
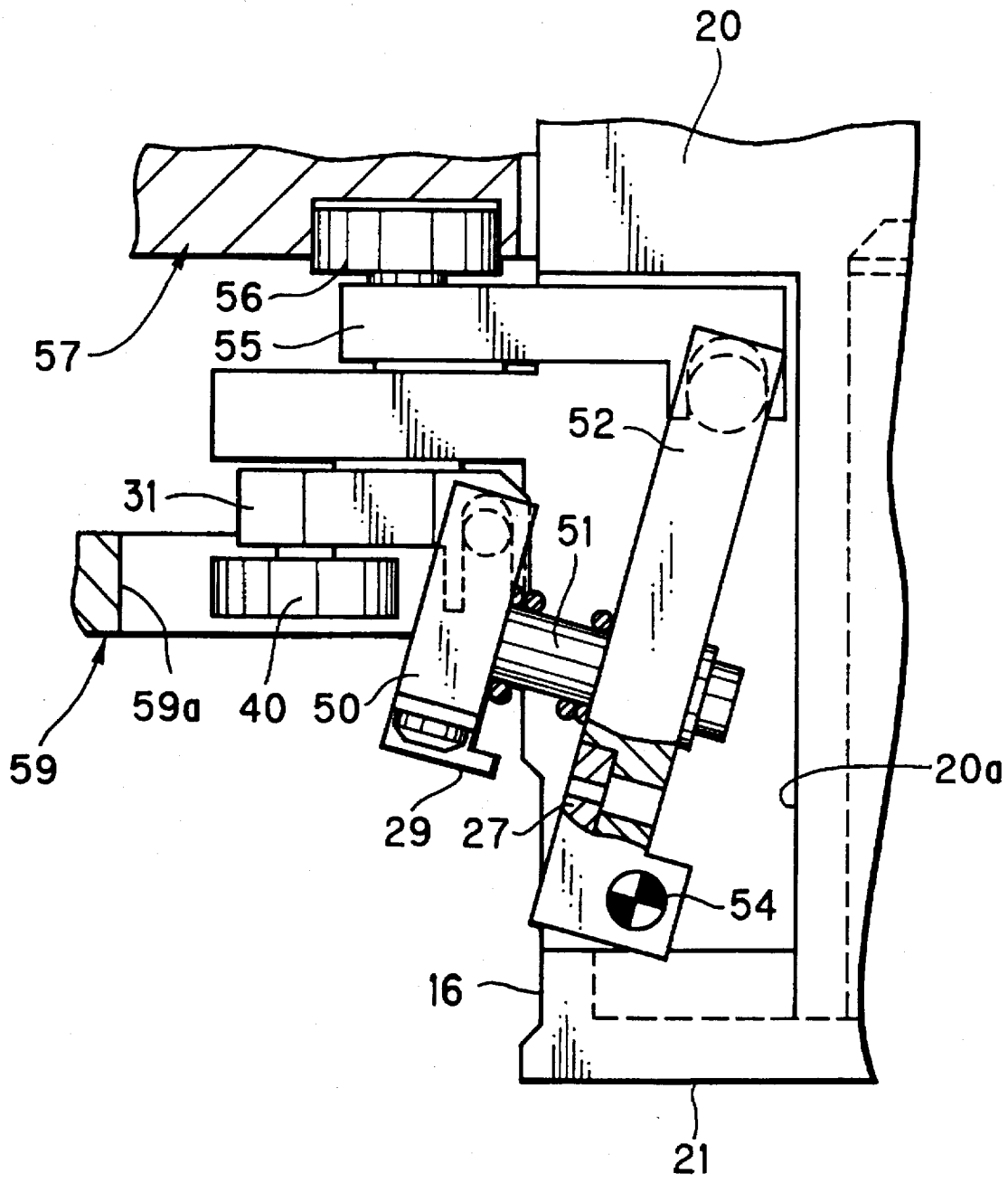
FIG. 8 is a view similar to that of FIG. 7 and illustrates the die set in its relief position.

FIGS. 7 and 8 illustrate another embodiment of the invention wherein a die holder is pivotally displaced between the standby position and the relief position. A punch holder 50 holding a punch 29 is coupled to a die holder 52 through a pair of guide rods 51 which extend in a radial direction of a drum 11 and in parallel to each other. The guide rods 51 are secured at one end thereof to the punch holder 50, while the other ends of the rods 51 are slidably fitted in bearings which are securely mounted in the die holder 52.

One end of the die holder 52 is pivoted on a shaft 54 which extends orthogonal to the guide rod pair 51 and substantially parallel to a film convey surface 16 of the drum 11. The other end of the die holder 52 is linked to a die drive member 55. The die drive member 55 is mounted on a radial projection 20*b* formed on the periphery of a cylindrical frame 20 of the drum 11, and is slidable radially thereon through a slide guide 55*a*, while a roller 56 slides along an annular cam groove 57*a* of a die drive cam 57 with the rotation of the drum 11. Thereby, the die holder 52 is caused to pivot about the shaft 54 between a standby position as shown in FIG. 7 and a relief position as shown in FIG. 8.

A coil spring 58 is provided on each guide rod 51 between the punch holder 50 and the die holder 51, so as to urge the punch holder 50 toward the retracted position, that is, to bias the punch 29 away from a die 27. Therefore, it is unnecessary to provide a cam surface in a punch drive cam 59 that causes the punch holder 50 to move into the retracted position. The punch drive cam 59 requires only a cam surface 59*a* for bringing the punch holder 50 radially into the punch position where the punch 29 is fitted in the die 27. Accordingly, the punch drive cam 59 may be easily manufactured at a low cost.

In this embodiment, those elements which may be equivalent to the first described embodiment are designated by the same reference numerals so that the detailed description thereof can be omitted for brevity.

The above two embodiments are also preferable because it is possible to minimize the stroke of the punch holder, which contributes to the precision of fitting between the punch and die.

Figure 9:
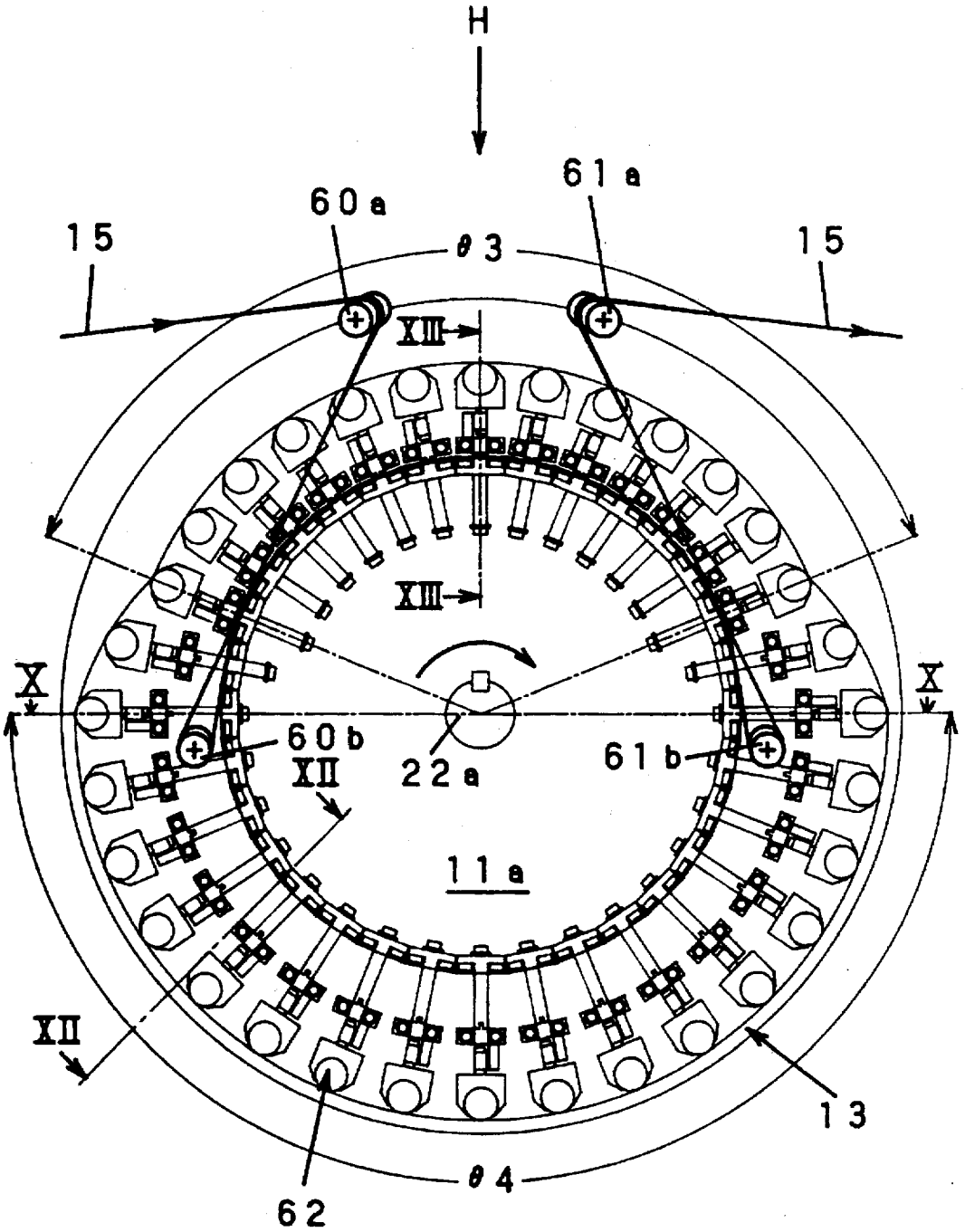
FIG. 9 is a front view of a perforator according to a third embodiment of the invention, with parts broken away for clarity.
Figure 10:
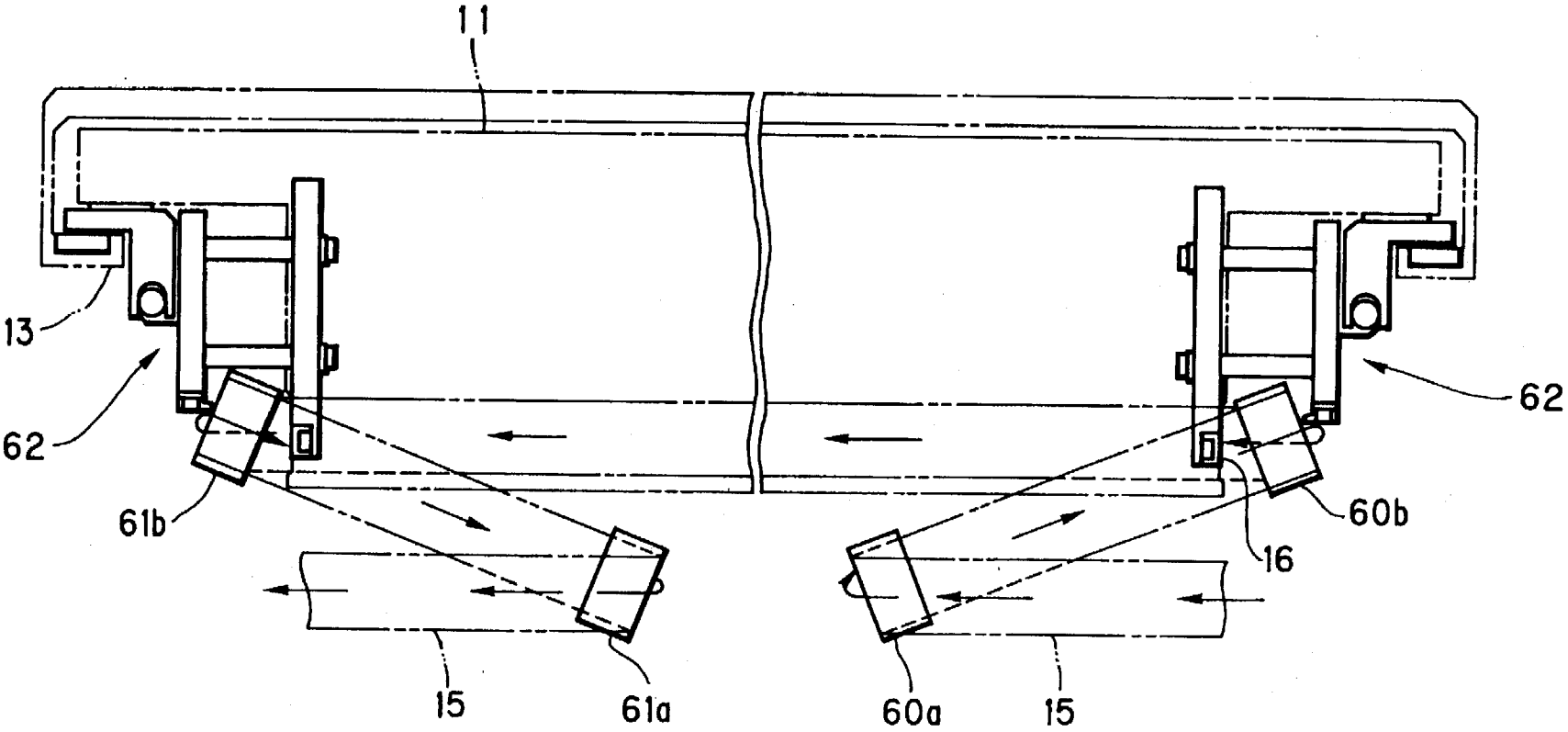
FIG. 10 is an explanatory end view of the perforator taken substantially along line X—X in FIG. 9.
Figure 11:
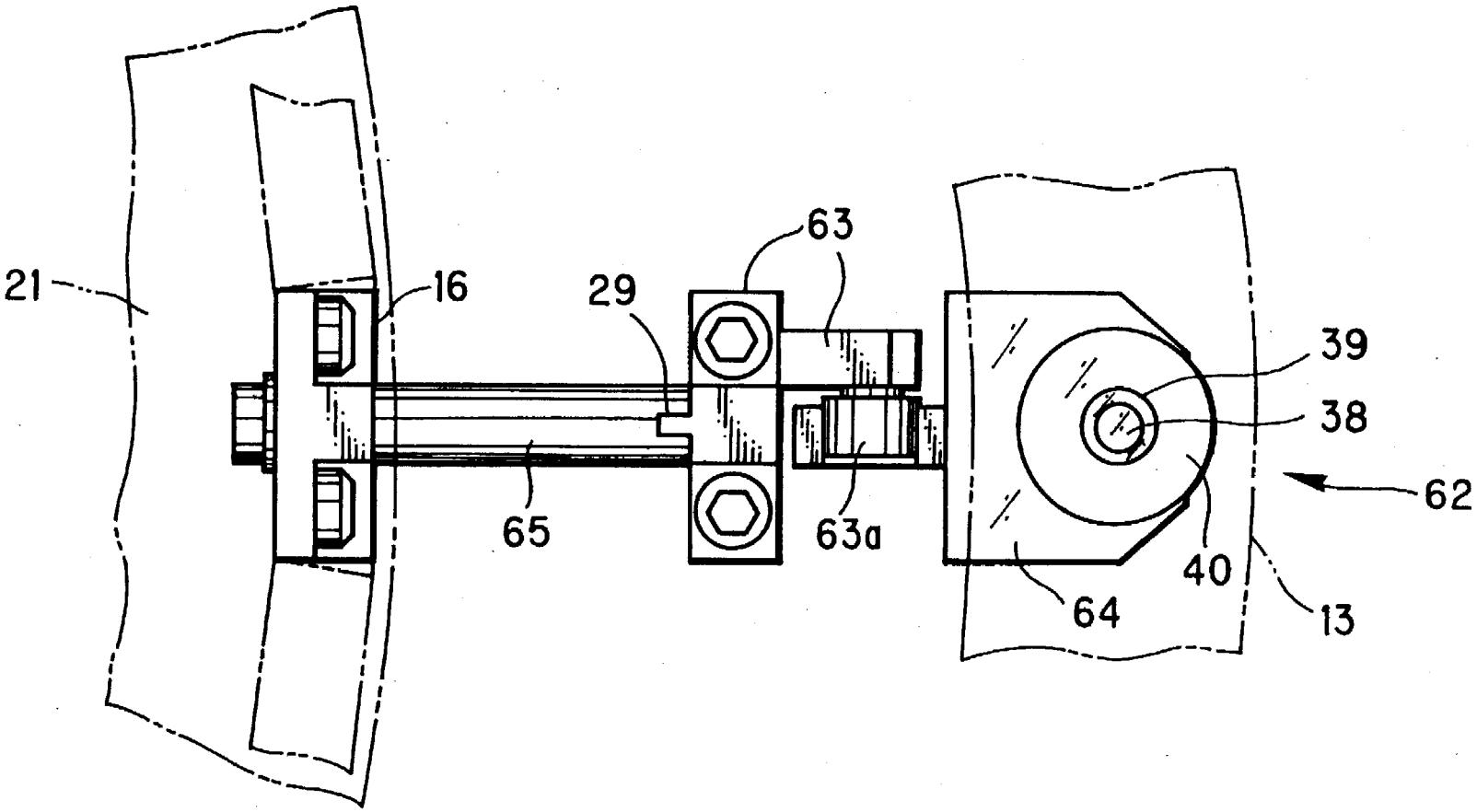
FIG. 11 is a front view of a die set of the perforator shown in FIG. 9, in its standby or retracted position.
Figure 12:
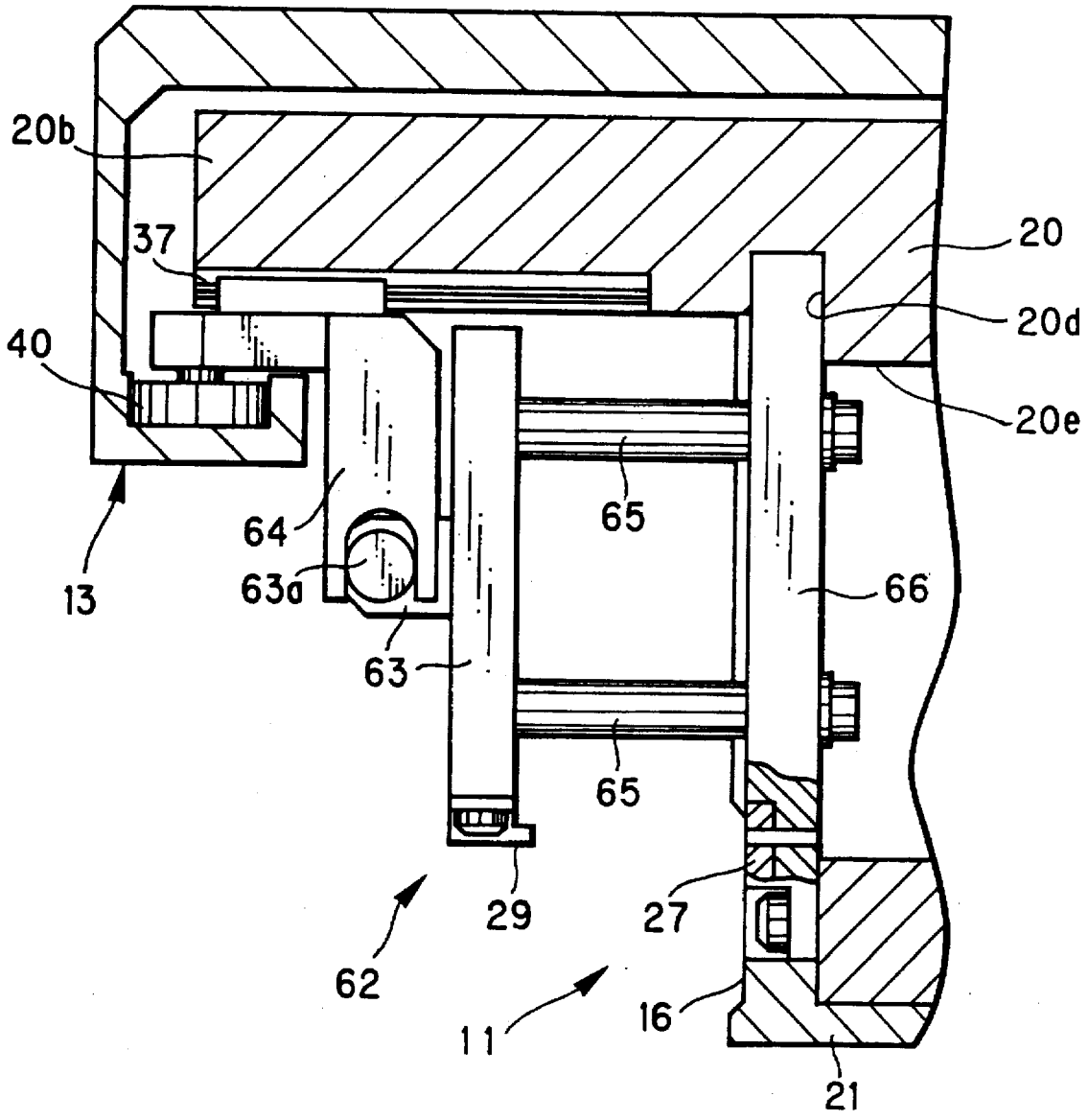
FIG. 12 is a side end view, partly in cross section, of the die set in its retracted position, taken along line XII—XII of FIG. 9.
Figure 13:
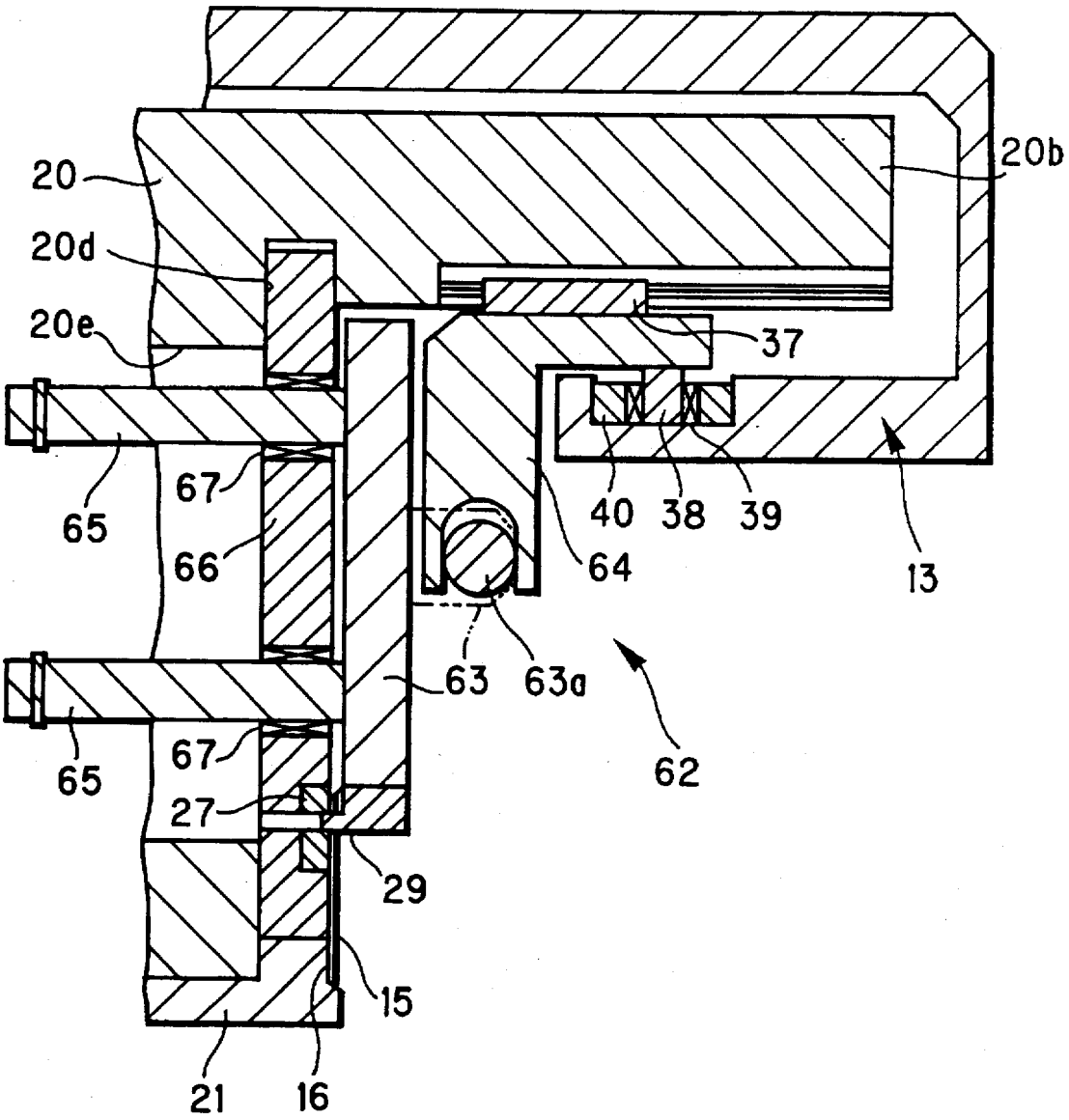
FIG. 13 is a sectional detail view of the die set in its punch position, taken along line XIII—XIII of FIG. 9.
Figure 14:
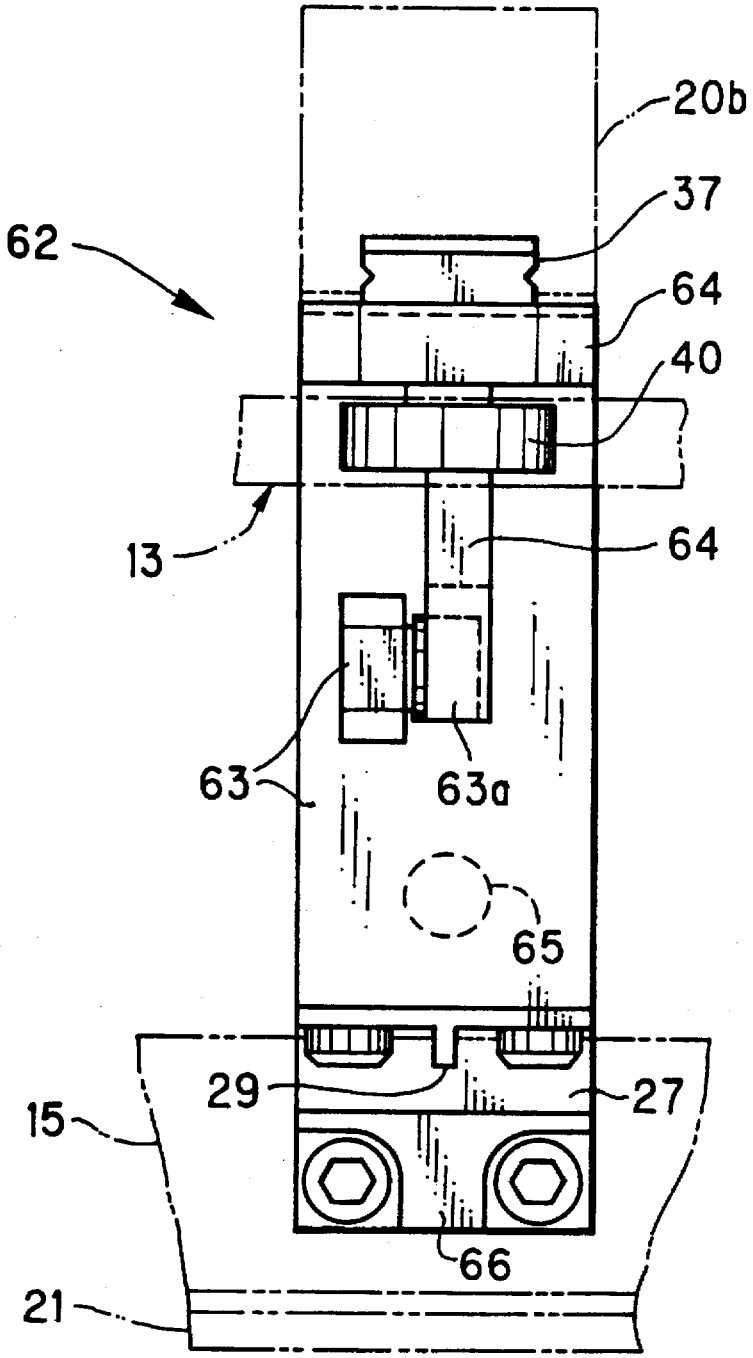
FIG. 14 is a view of the die set in the direction of the arrow H of FIG. 9.

In another embodiment shown in FIGS. 9 to 14, a photographic filmstrip 15 is not wound around a drum 11 but guided by four path rollers 60*a*, 60*b*, 61*a* and 61*b* in a manner as shown in FIGS. 9 and 10. That is, the first and fourth path rollers 60*a* and 61*a* are fixed proximate the drum 11 and displaced in the axial direction of the drum 11 downward from the film conveying surface 16, while the second and third path rollers 60*b* and 61*b* are stationed in the vicinity of the film conveying surface 16 on opposite horizontal sides of the drum 11 at portions beyond an angular range indicated by θ3 in FIG. 9. Within the range θ3, die sets 62 are in the punch position as shown in FIG. 13.

The axes of the first and second path roller 60*a* and 60*b* are inclined relative to the axis of the drum 11, such that, from the first path roller 60*a* to the second path roller 60*b*, the filmstrip 15 is conveyed in a direction that is slanted with respect to and reverse to the moving direction of the film conveying surface 16, and thereafter, brought into contact with the film conveying surface 16 in the same direction as the moving direction of the conveying surface 16. Then, the filmstrip 15 is conveyed on the film conveying surface 16 at the same speed and in the same direction as the surface 16. At the final contact position, the filmstrip 15 is turned by the third path roller 61*b* to the reverse direction toward the fourth path roller 61*a* for ejecting the filmstrip 15. The axes of the third and fourth path rollers 61*b* and 61*a* are also inclined relative to the axis of the drum 11, such that the filmstrip 15 is conveyed obliquely to the film convey surface 16 from the first to the fourth path rollers. The inclination of the path rollers 60*a* to 61*b* also prevents the filmstrip 15 from getting out of the film conveying surface 16.

In this way, the portions of the filmstrip 15 which are approaching or leaving the film conveying surface 16 cannot interfere with the die sets 62, without the need for displacing punches 29 in the axial direction of the drum 11 from the film conveying surface 16, similar to the relief positions of the above described embodiments. Therefore, it is only necessary to provide a punch drive cam 13 for moving the punches 29 in the radial direction of the drum 11. According to the this embodiment, the apparatus can have a simple construction.

As shown in detail in FIGS. 11 to 14, a punch holder 63 holding the punch 29 is driven by a punch drive cam 13 through a punch drive member 64 having a roller 40 engaged in the punch drive cam 13. The punch holder 63 is linked to the punch drive member 64 through a linkage member 63*a*. A pair of guide rods 65 are secured at their one ends to the punch holder 63. The guide rods 65 of one pair extend parallel to each other in a radial direction of the drum 11, and are arranged in the axial direction of the drum 11. The other ends of the guide rod pair 65 are fitted into bearings 67, which are securely mounted in a die holder 66, to permit the punch holder 63 to move in the radial direction of the drum 11 relative to the die holder 66. The die holder 66 is mounted in one of a plurality of recesses 20*d* formed on the periphery of a cylindrical frame 20 of the drum 11.

The guide rods 65 have a length long enough to keep the punch holder 63 from contacting the second and third path rollers 60*b* and 61*b* when the die sets 62 pass by these path rollers 60*b* and 61*b*, which are disposed in an angular range θ4 within which the punch holders 63 are radially retracted to the most from the die holder 66, as is shown in FIGS. 10 and 12.

Also in this embodiment, the punch drive member 64 transmits only the radial rectilinear motion of the roller 40 to the punch holder 63. The punch drive member 64 itself is slid on a radial projection 20*b* of the frame 20 through a single slide guide 37. Other elements may be similar to the first described embodiment, and thus a detailed description thereof is omitted for brevity.

Although the above described embodiments relate to a case where perforations are made along one side of the photographic filmstrip 15, it is possible to provide perforations along both lateral sides of the filmstrip 15 by disposing die sets on opposite lateral sides of the film conveying surface 16. Also, the perforator of the invention may be applicable to perforate any kind of long strip of sheet material other than photographic filmstrip. Also, the film conveying surface may be an endless surface moving around a plurality of rotational axes.

In order to achieve sharpness and accuracy of the die-punching process, it is necessary to impart stable tension to the long strip to be perforated. For this purpose, it is preferable to control the rotation of supply and take-up reels of the long strip according to a control method using fuzzy logic or the like, on the basis of the rotational speed and the acceleration of the rotary drum 11, the displacement of the die set, the rate of change of the displacement of die set, the diameters of the rolls of the long strip coiled around the supply reel and the take-up reels, and other parameters as input data.

While the present invention has been described in detail with respect to the embodiments shown in the drawings, the present invention should not be limited to these embodiments, but on the contrary, various modifications of the present invention can be effected without departing from the scope of the appended claims.

What is claimed is:

1. A method for forming perforations along a long strip of sheet material while continuously conveying said sheet material in a longitudinal direction thereof, said method comprising the steps of:

moving a plurality of die sets at a first speed in a first direction along with a peripheral surface of a circulating means, said die sets being arranged at regular intervals around said peripheral surface and each of said die sets having a die and a punch which are relatively linearly movable in opposite second and third directions which are perpendicular to said peripheral surface;

conveying said sheet material in contact with said peripheral surface in said first direction at said first speed;

die-punching said sheet material in an initial stage of said conveying step by moving said punch in one of said opposite second and third directions and fitting said punch into said die;

nipping said sheet material between said die and said punch fitted in said die through a perforation formed in said sheet material for a predetermined period after said die-punching step; and pivoting said die sets in a plane traversing said peripheral surface while maintaining the relative position between said die and said punch unchanged in each die set before and after said conveying step, so as to prevent said punch from interfering with said sheet material when said sheet material is approaching or leaving said peripheral surface.

2. A method as recited in claim 1, wherein said moving step comprises:

rotating said circulating means in said first direction.

3. A method as claimed in claim 1, wherein, in said die-punching step, the punch is moved linearly in said one of said opposite second and third directions by moving a roller connected to the punch along a cam surface of a stationary cam which is disposed proximate said peripheral surface.

4. An apparatus for forming perforations along a long strip of sheet material while continuously conveying said sheet material in a longitudinal direction thereof, said apparatus comprising:

circulating means having a peripheral surface which moves in a first direction;

a plurality of die sets, each having a punch and a die, arranged at regular intervals around said peripheral surface which move in said first direction along with said peripheral surface, each of said die sets having said die secured to a die holder which is mounted to said peripheral surface, and said punch secured to a punch holder which is linearly movable in opposite directions perpendicular to said peripheral surface between a punch position, where said punch is fitted in said die, and a retracted position, where said punch is retracted away from said die;

roller means, disposed outside said peripheral surface, for bringing a portion of said sheet material into contact with said peripheral surface so as to convey said sheet material on said peripheral surface in said first direction at the same speed as said die sets;

punch drive means coupled to said punch holder for driving said punch holder relative to said die holder to move in one of said opposite directions perpendicular to said peripheral surface, said punch drive means keeping said punch in said punch position for a predetermined circulating period of said die sets so as to nip said sheet material between said dies and said punches through said perforations; and shift means for pivoting said die sets relative to said sheet material in a transverse direction with respect to said peripheral surface into a relief position where said punch cannot interfere with said sheet material when said sheet material is approaching or leaving said peripheral surface, a relative position between said punch holder and said die holder remaining constant while said shift means pivots said die sets.

5. An apparatus as recited in claim 4, wherein said circulating means includes a rotary drum rotating about an axis in said first direction.

6. An apparatus as recited in claim 4, wherein said punch drive means comprises a stationary punch drive cam disposed along said peripheral surface and a cam roller coupled to said punch holder and sliding along said cam while said die sets are circulating along with said peripheral surface.

7. An apparatus as recited in claim 6, wherein said punch drive means further comprises a sliding member disposed in each of said die sets and slidable in said opposite directions perpendicular to said peripheral surface, said sliding member coupling said cam roller to said punch holder so as to transmit only a component of motion of said cam roller to said punch holder that causes said punch holder to move in said second opposite directions.

8. An apparatus as recited in claim 7, wherein said die set further has a base and at least a guide rod coupled to said base, said guide rod guiding said punch holder linearly in said opposite directions perpendicular to said peripheral surface, one end of said guide rod being slidably fitted in a bearing which is securely mounted in one of said punch holder and said die holder.

9. An apparatus as recited in claim 8, wherein said die set further has a spring disposed between said punch holder and said die holder for urging said punch holder toward said retracted position.

10. An apparatus as recited in claim 9, wherein said die holder and said punch holder are pivotal in a plane traversing said peripheral surface while maintaining the relative position between said die and said punch unchanged in each die set, and said shift means comprises cam means for pivotally displacing said die holder together with said punch holder away from said peripheral surface.

* * * * *